United States Patent [19]

Koonce

[11] 4,058,331

[45] Nov. 15, 1977

[54] REMOTELY ACTUATED TWO STAGE STRUCTURAL LATCH

[75] Inventor: George W. Koonce, Fort Worth, Tex.

[73] Assignee: The United States of America as represented by the Secretary of the Air Force, Washington, D.C.

[21] Appl. No.: 738,496

[22] Filed: Oct. 29, 1976

[51] Int. Cl.[2] ..... E05C 19/10

[52] U.S. Cl. ..... 292/97; 292/123; 292/196; 292/221

[58] Field of Search ..... 292/214, 216, DIG. 31, 292/117, 118, 97, 123, 125, 221, 223, 225, 196

[56] References Cited

U.S. PATENT DOCUMENTS

| | | | |
|---|---|---|---|
| 2,110,256 | 3/1938 | Barr et al. | 292/125 |
| 2,199,467 | 5/1940 | Saunders | 292/221 |
| 4,003,614 | 1/1977 | Geer et al. | 292/97 |

FOREIGN PATENT DOCUMENTS

| | | | |
|---|---|---|---|
| 1,096,797 | 1/1961 | Germany | 292/123 |

*Primary Examiner*—Paul R. Gilliam
*Assistant Examiner*—Kenneth J. Dorner
*Attorney, Agent, or Firm*—Joseph E. Rusz; Arsen Tashjian

[57] ABSTRACT

A two stage remotely actuated structural latch especially suitable for supporting an aircraft canopy during flight as well as on the ground. One single part of the latch carries all of the load and the latch can be locked or unlocked from a remote location by use of a rod, cable or tube to acruate only non-structurally loaded pins and links which have high mechanical advantage in the first stage unlocking movement. This arrangement permits emergency canopy release during flight by the application of average human leverage and provides maximum pull up capability at the time of maximum mechanical advantage. A self-aligning and floating hook pin concept eliminates the need for hook and mating pin alignment.

4 Claims, 4 Drawing Figures

FIG. 1
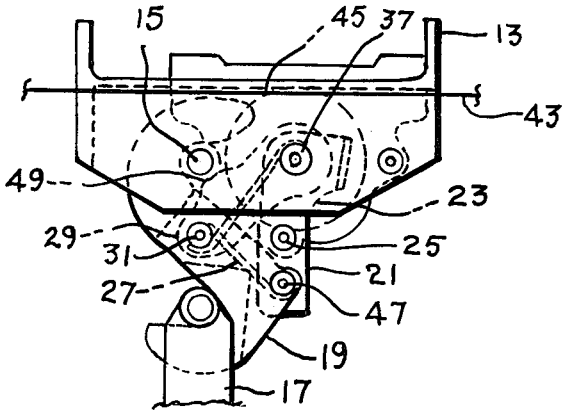
FIG. 2
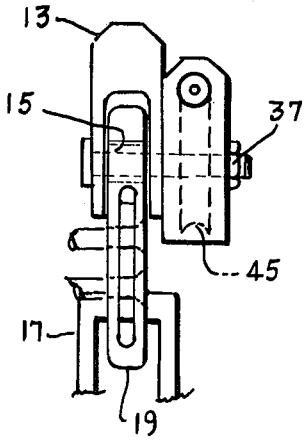
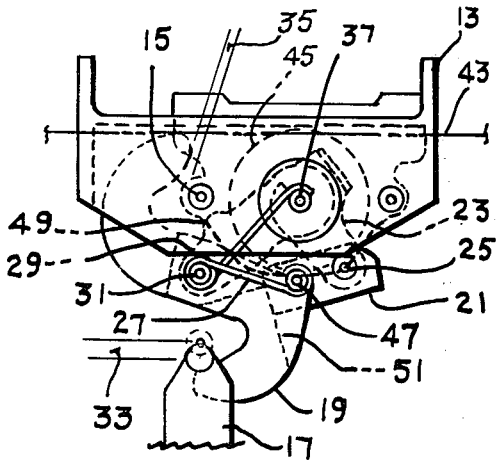
FIG. 3
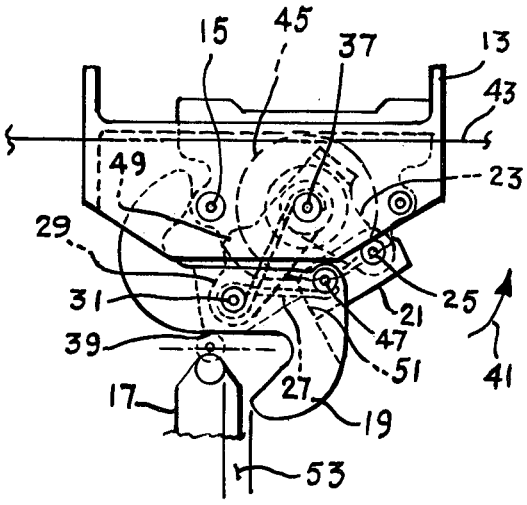
FIG. 4

REMOTELY ACTUATED TWO STAGE STRUCTURAL LATCH

STATEMENT OF GOVERNMENT INTEREST

The invention described herein may be manufactured and used by or for the Government for governmental purposes without the payment of any royalty thereon.

BACKGROUND OF THE INVENTION

This invention relates to a remotely actuated two stage structural latch and, more particularly, the invention is concerned with providing a latching device which is especially adaptable for use in supporting an aircraft canopy for flight loads and in such a manner that the aircraft canopy latch can be remotely locked or unlocked while the aircraft is on the ground or unlocked for emergency canopy ejection during flight.

Heretofore, various devices have evolved for purposes of canopy latching including, for example, sliding latches sliding hooks, rotating hooks and various shaped bolts. These devices usually require hydraulic, pneumatic, electrical or pyrotechnic power devices to cut, shear, unlock or disengage for emergency canopy opening.

Several disadvantages are inherent in such systems which lack the advantages of easy manual release. Because of the high forces required to open and close the canopies under load and since the sliding hook and rotating hook devices have a high degree of friction loss when operated under load, usually a powered device is required to operate the system for normal ground operations and explosive devices are usually necessary to either cut or shear the latch supporting pin for emergency canopy release.

The hereinafter disclosed latch carries all of the load in one single part and can be locked and unlocked from a remote location by use of a rod, cable or tube to activate only non-structurally loaded pins and links which have a high mechanical advantage in the first stage unlocking movement. Therefore, the emergency release of the loaded latch according to my invention can be accomplished by applying average human leverage or by the initial movement of the device used to eject a canopy.

SUMMARY OF THE INVENTION

The present invention is concerned with providing an improved latching device that can be remotely actuated and carries all the load in one single part. The latch has a positive non loaded locking feature and a high mechanical advantage pull-up capability as well as a self aligning and floating hook pin concept which requires no hook and mating pin alignment. Individual latch adjustment requires no connecting linkage adjustments when two or more latches are actuated simultaneously and a two stage hook movement permits a varying high mechanical advantage hook movement for locking and unlocking under load. The latch is further characterized by a constant low mechanical advantage hook movement for non loaded hook positioning for opening clearances.

Accordingly, it is an object of the invention to provide a latch which will carry all of the loads in only one part of the latch and can be opened or closed from a remote location.

Another object of the invention is to provide a remotely actuated latch which has the maximum amount of pull up capabilities at the time of maximum mechanical advantage.

Still another object of the invention is to provide a remotely actuated latch which can be individually adjusted by using a varying spline on the driver, shaft and link such that no connecting linkage or push pull cable sequencing adjustments are required when two or more latches are actuated simultaneously.

A further object of the invention is to provide a remotely actuated latch which operates to force the two parts to separate after the latch is released.

These and other objects, features and advantages will become more apparent after considering the following detailed description taken in conjunction with the annexed drawings and appended claims.

BRIEF DESCRIPTION OF THE DRAWINGS

FIG. 1 is a plan view which diagramatically illustrates the apparatus according to the invention in the fully latched position;

FIG. 2 is an end view of the apparatus of FIG. 1;

FIG. 3 is a plan view of the apparatus which diagramatically illustrates the pull up capabilities in a partially latched position; and FIG. 4 is a plan view of the apparatus which diagramatically illustrates the fully unlatched position.

DESCRIPTION OF A PREFERRED EMBODIMENT

Referring now to the drawings wherein like reference numerals refer to like elements in the several views, the body to be fastened is shown as a support housing 13 with the pin 15 thereon for attachment to the clevis pin 17. An S shaped hook 19 provides the only structural load carrying member connecting housing 13, pin 15 and clevis pin 17. The load between clevis pin 17 and pin 15 is in line in hook 19 therefore no rotating forces exist to release or unlock hook 19. Inadvertent unlock of hook 19 is secured by an over center alignment of link 21 and link 23 at pin 25 and the pressure is maintained from safety spring 27.

A two stage hook 19 movement is required to connect or release the tie between pin 15 and clevis pin 17. The first stage hook 19 movement is to rotate hook 19 about link 29 at pin 31 to create clearances 33 and 35, thus releasing the structural tie between pin 15 and clevis pin 17 as shown in FIG. 3. The second stage hook 19 movement is to lock hook 19 to link 29 at pin 31 and rotate hook 19 and link 29 around shaft 37 to create clearance gap 39 such that housing 13, pin 15 and clevis pin 17 can be separated as shown in FIG. 4. Housing 13, pin 15 and clevis pin 17 can be forced apart when hook 19 and pin 17 make contact at surface 39 and hook 19 is rotated around shaft 37 in the direction of the arrow 41.

Pushing, pulling or rotating the rod, cable or tube 43 causes the drive wheel or arm 45 to rotate. Drive wheel 45 is spline locked to shaft 37. Link 23 is spline locked to shaft 37. Rotation of shaft 37 rotates link 23 around shaft 37. Link 21 is pinned to link 23 at pin 25, and moves with link 23 and pivots around pin 25. Link 21 is pinned to hook 19 and pivots around pin 47. Link 29 is pinned to hook 19 and is free to pivot at pin 31. Link 29 is pinned to shaft 37. Link 29 can pivot freely around shaft 37. Link 29 has a stop 49 to contact pin 15. Link 21 is free to pivot on pin 47 until stop 51 on hook 19 restricts rotation. Link 29 is free to rotate around shaft 37 until stop 49 contacts pin 15 and restricts rotation.

The shaft 37 has a clearance undercut separating the even and uneven numbered spline section sufficient to move the shaft 37 in and out to disengage the spline sections in driver 45 and link 23. With shaft 37 not spline locked to driver 45 or link 23, the angle relation between driver 45 and link 23 can be adjusted. Since the splines on each end of shaft 37 are even and odd in number, shaft 37 can be rotated slowly until alignment is found between the driver 45, link 23 and shaft 37 splines. The shaft 37 is then inserted and the driver 45, link 23 become locked to shaft 37. The individual latch adjustment eliminates the need for rod 43 adjustment between the latches when two or more latches are actuated simultaneously.

MODE OF OPERATION

In operation, to unlock and open the latch, the push-pull device 43 is actuated. Driver 45 is rotated thus rotating shaft 37. Shaft 37 rotates link 23. Link 23 moves and pivots link 21 at pin 25. Link 21 moves and pivots hook 19 at pin 47. Hook 19 contacts pin 15 restricting pivot or hook 19 around shaft 37. Hook 19 can only pivot around link 29 at pin 31 until clearance 35 permits hook to clear pin 15 and link 21 rotates on pin 47 until link 21 contacts stop 51 on hook 19.

Hook 19 becomes fixed to link 21 at pin 47; and to link 29 at pin 31. Link 21 becomes fixed to link 23 at pin 25. Therefore additional rotation of shaft 37 rotates spring 27, link 21, 23, and 29, the pins 31, 47 and 25 and hook 19 as a fixed unit around shaft 37 until hook 19 strikes clevis pin 17 at surface 39. Increased rotation of shaft 37 forces separation of pin 15 and clevis pin 17. Gap 53 can be any amount that is sufficient to permit separation of the housing 13, pin 15 and clevis pin 17 as shown in FIG. 4.

To close and lock the latch, the push pull device 43 is actuated (in the reverse direction used for opening). Driver 45 is rotated thus rotating shaft 37 which rotates fixed unit: spring 27, links 21, 23, and 29, pins 31, 47 and 25, and hook 19 until hook 19 contacts clevis pin 17 or stop 49 on link 29 contacts pin 15. This stops rotation of fixed unit hook 19 from rotating around shaft 37. Link 23 continues to be rotated by shaft 37 rotation. Link 23 moves and rotates link 21 around pin 25. Link 21 moves hook 19 and rotates around pin 47. Stop 49 on link 29 is in contact with pin 15 thus locking position of pin 31. This stops rotation of hook 19 around shaft 37. Hook 19 is forced to rotate around pin 31. Hook 19 is in contact with clevis pin 17 with gap 33 existing. Hook 19 rotation around pin 31 will close gap 33 and gap 35 until hook 19 is in locked position in line with pin 15 and clevis pin 17 as shown in FIG. 1.

Although the invention has been illustrated in the accompanying drawing and described in the foregoing specification in terms of a preferred embodiment thereof, the invention is not limited to this embodiment or to the particular configuration shown and described. It will be apparent to those skilled in the art that certain changes, modifications and substitutions can be made, particularly with respect to the shape and positioning of the various links and pins without departing from the true spirit and scope of the appended claims.

Having thus set forth the nature of my invention, what I claim and desire to secure by Letters Patent of the United States is:

1. A remotely actuated two stage structural latch comprising, in combination, a support housing, a main shaft passing through and rotatable in said housing, a first link having one end pivotally attached to one end of said main shaft, an S shaped hook member pivotally attached to the other end of said first link, a second link having one end attached to said main shaft for pivotting on a common axis with said first link, a first pivot pin disposed on the other end of said second link, a third link having one end pivotally attached to said second link for pivotting around said first pivot pin, the other end of said third link being pivotally attached to a second pin on said S shaped hook, a third pin fixedly attached to said support housing, a clevis pin in spaced alignment with said third pin, and means for rotating said main shaft to produce a corresponding rotation of said first link causing said S shaped hook to rotate and engage said third pin and said clevis pin, further rotation of said S shaped hook member operating to draw said clevis pin and said support member nearer together when the rotation is in clockwise direction and operating to release the support member from the clevis pin when the rotation is in the counterclockwise direction.

2. The remotely actuated two stage structural latch defined in claim 1 wherein the means for rotating said main shaft includes a driver wheel attached to the other end thereof and a push pull device attached to said driver wheel such that actuation of said push pull device causes said driver wheel to rotate and produce a corresponding rotation of said main shaft.

3. The remotely actuated two stage structural latch defined in claim 2 wherein a stop is disposed on one side of said first link, said stop contacting said third pin for preventing further rotation of said first link around said main shaft.

4. The remotely actuated two stage structural latch defined in claim 2 wherein a safety spring is positioned around the pivotal attachment point of said first link and said S shaped hook member, said safety spring urging said third link into a locking position thereby preventing inadvertent unlock of the latch.

* * * * *